US006881448B1

(12) United States Patent
Hattori

(10) Patent No.: US 6,881,448 B1
(45) Date of Patent: Apr. 19, 2005

(54) METHOD FOR PRODUCING POLYMER-PARTICLE COMPOSITES

(75) Inventor: Hideshi Hattori, Tokyo-to (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 89 days.

(21) Appl. No.: 09/705,027

(22) Filed: Nov. 2, 2000

(30) Foreign Application Priority Data

Nov. 4, 1999 (JP) ..... P11-313522
Jun. 16, 2000 (JP) ..... 2000-181594

(51) Int. Cl.[7] ..... B05D 7/24; B05D 1/12
(52) U.S. Cl. ..... 427/307; 427/202; 427/443.2
(58) Field of Search ..... 427/202, 307, 427/407.1–412.5, 419.5, 430.1, 443.2, 259, 261, 287, 243, 180, 205, 245, 247, 258, 331, 333, 336, 372.2, 402, 419.1, 419.2

(56) References Cited

U.S. PATENT DOCUMENTS 4,061,827 A * 12/1977 Gould ..... 219/553
4,451,412 A 5/1984 Loiseaux et al.
5,501,877 A * 3/1996 Adair et al.

FOREIGN PATENT DOCUMENTS

JP 05085716 4/1993
JP 06335629 12/1994
JP 08234007 A 9/1996

OTHER PUBLICATIONS

J. Majewski, et al., Structural Studies of Polymer–Cushioned Lipid Bilayers, Biophysical Journal, vol. 75, Nov. 1998, pp. 2363–2367.

Orlin D. Velev et al., "Structured porous materials via colloidal crystal templating: From inorganic oxides to metals", Advanced Materials—Research News, 2000, pp. 531–534.

Hiroshi Taoda, "Dye sensitized solar cell using Ti02 porous film", The Institute of Electronics, information and communication engineers technical report, pp. 13–18.

Cefe Lopez et al. Advanced Materials, vol. 9, No. 3, pp257–260 (1997).

Cefe Lopez et al. Langmuir, vol. 15, pp4701–4704 (1999) Electrophoretic Deposition To Control Artificial Opal Growth.

L.F. Chi et al. Langmuir, vol. 13, pp7121–7124 (1997) Influence of the Evaporation Rate on the Packing Order of . . . .

Amy E. Larsen et al. Nature, vol. 385, pp230–233 (1997) Like–Charge Attractions in Metastable Colloidal Crystallites.

Richard P: Van Duyne et al; Journal of Vaccum Science and Technology (A) vol. 13, pp1553–1558 (1995) Nanosphere lithography: A materials general fabrication . . . .

Younan Xie et al. Advance Materials, vol. 10, pp1028 (1998).

* cited by examiner

*Primary Examiner*—Fred J. Parker
(74) *Attorney, Agent, or Firm*—Timothy J. Keefer; Seyfarth Shaw LLP

(57) ABSTRACT

An objective of the invention is to provide a method for producing a polymer-particle composite by which a polymer-particle composite having a desired particle density and a desired film thickness can be produced conveniently without allowing the particle to be aggregated in the polymeric matrix. To accomplish the objective described above, the present invention provides a method for producing a polymer-particle composite comprising a step of forming a polymer-containing layer mainly consisting of a polymeric material and a step of bringing a particle suspension containing the particle suspended in a solvent capable of swelling the polymeric material into contact with the polymer-containing layer.

16 Claims, 9 Drawing Sheets

Surface

Surface and sectional area

Sectional area of substrate side

Sectional area of vacuum side

METHOD FOR PRODUCING POLYMER-PARTICLE COMPOSITES

CROSS REFERENCE TO RELATED APPLICATION

This application claims the priority of Japanese patent application Serial No. P11-313522 filed on Nov. 4, 1999 and Japanese patent application Serial No. 2000-181594 filed on Jun. 16, 2000.

BACKGROUND OF THE INVENTION

The present invention relates to a method for producing a polymer-particle composite capable of forming a display material such as a light diffusion plate, an optical material such as a colloidal crystal, a building material such as a wallpaper, a noncombustible material, a catalyst material, a separation membrane, an electrode material, a decorative paper, a film, an accessory and a toy.

Recently, there is an increasing interest on a nm- or μm-sized particle because of an industrial utility which varies depending on the particle size. For example, a dendrimer having a particle size of several nanometers to several ten nanometers has a specific property such as antenna effect, while a metal particle or a semiconductor particle having a particle size of several nanometers to several ten nanometers is expected to be applicable to a device material utilizing a quantum effect. An oxide particle having a particle size of several nanometers to several ten nanometers is also applicable to an abrasive, a film filler, a paint filler, a ceramic additive, a pigment, a fluorescent substrate, a magnetic material and the like, while an oxide or a polymeric particle having a submicron particle size is applicable to an optical material such as a colloidal crystal and a photonic crystal. Furthermore, an oxide or a polymeric particle having a particle size of several micrometers to several ten micrometers is expected to be applicable to an optical material such as a light diffusion plate, and a light diffusion plate for a display employing an oxide particle has already been used practically.

In the industrial field of application described above, an efficient utilization of the characteristics of a particle requires a regular or random inclusion of the particle in a support material such as a polymeric material without aggregation of the particle. A technology for such inclusion is considered to be very important in these days, and various methods have been reported.

For example, a colloidal crystal was produced by a method for obtaining a colloidal crystal in a dispersion (JP-A-5-85716, JP-A-6-335629), a sedimentation method (Ceffe Lopez et al., Advanced Materials, vol. 9, No. 3, pp 257–260 (1997), an electrophoretic method (Ceffe Lopez et al., Langmuir, vol. 15, pp 4701–4704 (1999)), a solvent evaporation method (L. F. Chi et al., Langmuir, vol. 13, pp7121–7124 (1997)), a vertical deposition method (JP 2905712), an electrostatic interaction method (Amy E. Larsen et al., Nature, vol. 385, pp230–233 (1997)), a spin coating method (Richard P. Van Duyne et al., Journal of Vacuum Science and Technology (A) vol. 13, pp 1553–1558 (1995)), an injection method (Younan Xie et al., Advance Materials, vol. 10, pp. 1028 (1998)), a matrix polymerization method (U.S. Pat. No. 4,451,412) and the like. However, any of the methods described above involves a problematic disadvantage, such as a prolonged production time, a difficulty or an impossibility experienced in controlling the film thickness, the requirement of a cell or a sealing, the lack of self-standing ability, and the like.

While a method in which a liquid formulation containing a polymeric material and a particle is applied onto a substrate and then the medium is evaporated off has also been employed, it allows the particle to be aggregated readily when the particle is small, and involves a problematic limitation with regard to the particle content.

SUMMARY OF THE INVENTION

In view of the problems described above, the present invention is intended mainly to provide a method for producing a polymer-particle composite capable of producing a polymer-particle composite having a desired film thickness and a desired particle density conveniently without undergoing any aggregation of the particle in a polymeric matrix.

Thus, an objective of the invention is to provide a method for producing a polymer-particle composite comprising a step of forming a polymer-containing layer mainly forming of a polymeric material and a step of bringing a particle suspension containing the particle dispersed in a solvent capable of swelling the polymeric material into contact with the polymer-containing layer.

We discovered that by bringing a polymer-containing layer forming of a polymeric material into contact with a particle suspension containing a particle dispersed therein the particle can be packed uniformly in the polymer-containing layer without undergoing any aggregation as a result of the effects such as a van der Waals force and a desolvation exerted upon the swelling of the polymer-containing layer as a result of the effect of the solvent (medium) in the particle suspension described above, and finally establishing the present invention. Accordingly, in the present invention, a simple contact of a polymer-containing layer with a particle suspension enables a production of a polymer-particle composite having a desired particle density and a desired film thickness conveniently without allowing the particle to be aggregated, thus allowing a polymer-particle composite to be produced conveniently.

It is preferred that the polymer-containing layer described above is formed on a substrate and is brought, as is still on the substrate, into contact with the particle suspension, since it can more easily be handled when it is still on the substrate upon being brought into contact with the particle suspension in view of the fact that it is usually a thin film whose characteristics such as the strength should be taken into account.

It is also preferred that a polymer-containing layer described above is formed as a pattern on a substrate. By forming a polymer-containing layer as a pattern on the substrate and bringing this polymer-containing layer into contact with a particle suspension, a layer packed with the particle can be formed as a pattern. As a result, it comes to be possible to produce a pattern-bearing body having a varying function, such as an electronic circuit if the particle described above is a conductive particle such as a metal.

A substrate which can be employed here is, a metal, a semiconductor, an inorganic material, a film or an unwoven fabric, and can be selected based on the function of an intended polymer-particle composite.

In a method for producing a polymer-particle composite according to the present invention, it is preferred that the step of bringing the particle suspension into contact with the polymer-containing layer is a step of immersing the polymer-containing layer in the particle suspension or a step of applying the particle suspension onto the polymer-containing layer, since these two steps are preferred for an easier handling in a manufacturing process.

Also in a method for producing a polymer-particle composite according to the present invention, it is preferred that a polymeric material described above is polyelectrolytes, since a use of a polymeric material as polyelectrolytes enables, upon a contact between a particle suspension and a polymer-containing layer, not only a desolvation but also the formation of a high salt concentration region on the surface of the polymer-containing layer, where it is possible to impart a particle invading this region with an instability, whereby promoting the incorporation and the packing of the particle into the polymeric material in the polymer-containing layer.

Also in a method for producing a polymer-particle composite according to the present invention, it is preferred that polyelectrolytes described above is a polyelectrolyte having a charge opposite to the charge possessed by the particle, since a use of the charge possessed by the particle which is opposite to the charge possessed by the polyelectrolyte allows the particle to be incorporated into and immobilized in the polyelectrolyte strongly as a result of an electrostatic attraction in addition to a van der Waals force, whereby allowing the particle to be packed stably in the polymeric material and also to be packed in the polymeric material at a high density.

In a method for producing a polymer-particle composite according to the present invention, it is preferred that polyelectrolytes described above is a water-soluble polyelectrolyte, since a useful particle-containing suspension is frequently an aqueous colloid solution and thus a water soluble polymeric material, especially polyelectrolytes, is preferred when such particle suspension is employed. Also when a high salt concentration region is formed on the surface of the polymer-containing layer described above to impart a particle in a particle suspension with an instability or when an electrostatic attraction is employed to incorporate and immobilize a particle into a polymeric material, the ionization degree can be increased and a higher efficiency is achieved by employing an aqueous system.

In a method for producing a polymer-particle composite according to the present invention, it is preferred that the mean particle size of the particle is 1 nm to 100 $\mu$m, since an industrially useful particle frequently has a mean particle size within this range.

Also in the above described case, it is possible to use as a particle described above one or more selected from a group of an oxide, a metal, a semiconductor and a substance containing carbon as a structural element or a mixture thereof. Such particle is selected based on the function required for an intended polymer-particle composite.

In a method for producing a polymer-particle composite according to the present invention, it is preferred that the concentration of a particle in a particle suspension is 1% by volume to 65% by volume. This concentration of a particle in a particle suspension is determined depending on the density of the particle required for an intended polymer-particle composite.

In a method for producing a polymer-particle composite according to the present invention, it is preferred that a solvent capable of swelling a polymeric material is a solvent having a dielectric constant of 2 or more or a mixture thereof, since it is preferred to use as a polymeric material a water-soluble polymer as described above and such water-soluble polymer is dissolved preferably by a solvent having a dielectric constant of 2 or more.

In the above described case, it is preferred that a solvent capable of swelling a polymeric material described above is a water-containing solvent, since to use as a solvent a water-containing aqueous solvent enables an easy swelling even when polyelectrolytes is employed as a water-soluble polymer, and also since an aqueous solvent is preferred either when a high salt concentration region is formed to impart a particle with an instability or when an electrostatic attraction is used to immobilize a particle into a polymeric material as described above.

Also in the present invention, a polymer-particle composite produced by a method for producing a polymer-particle composite according to the present invention is provided.

A polymer-particle composite obtained by a method described above comprises a particle packed uniformly in a polymeric material and has a self-standing ability, and is characterized in that the mean particle size of the particle is 1 $\mu$m or less.

Even if using a particle having a mean particle size of 1 $\mu$m or less which undergoes an aggregation and can not successfully provide a uniform particle dispersion when handled by a conventional method in which a liquid containing a polymeric material and a particle is applied onto a certain substrate and the medium is evaporated off or by a similar method, an inventive method allows such particle to be packed as dispersed uniformly over a polymeric material, whereby exerting the properties required for a polymer-particle composite efficiently. A polymer-particle composite according to the invention can be used also without using any substrate because of having a self-standing ability.

In the case of a polymer-particle composite described above, it is preferred that a polymeric material is polyelectrolytes having a charge opposite to the charge possessed by the particle, since a use of such polymeric material allows a particle to be packed stably in a polymeric material as described above and also to be packed at a high density in the polymeric material.

Also in the case of a polymer-particle composite described above, it is possible that a particle is present in an amount of 1% by volume or more. While a particle should be packed at a high density for a certain purpose of use of a polymer-particle composite, the present invention can provide a polymer-particle composite packed at such a high density.

In a polymer-particle composite according to the present invention, it is possible that the particle content varies continuously over the range from one side to the other.

For example, when a polymer-containing layer is formed on a substrate and then brought into contact with a particle suspension, a polymer-particle composite having the characteristics described above can be obtained according to the conditions.

As described above, the present invention provides a colloidal crystal comprising the above described polymer-particle composite. By a simple manufacturing process described above, a colloidal crystal can be obtained.

In addition, the present invention provides a sintered particle produced by sintering the polymer-particle composite described above. By using such sintered particle as a mold, a porous material of a semiconductor or a metal which can widely be employed can be obtained.

Also the invention provides a method for producing a porous material comprising a step of forming a polymer-particle composite by a method for producing a polymer-particle composite according to the present invention using a particle capable of being decomposed by means of a heat treatment or a chemical treatment or being extracted out, a step of filling a certain material into a pore between the particles in the polymer-particle composite and a step wherein the particles in the polymer-particle composite are decomposed by means of a heat treatment or a chemical treatment or being extracted out whereby removing the particle.

Thus, by forming a porous material using as a mold a polymer-particle composite obtained by a method for producing a polymer-particle composite described above, a porous material having a pore whose size is smaller and uniform and also having a higher porosity can be obtained. Accordingly, various applications including a catalyst, a separation membrane, an electrode, a capacitor, a photonic crystal and the like, are possible.

In a method for producing a porous material described above, a step of filling a certain material into a pore between the particles in the polymer-particle composite may be a step of filling a metal into a pore between the particles by means of an electrolytic plating or an electroless plating. As a result, a metallic porous layer having a pore whose size is smaller and uniform and also having a higher porosity can be formed and used preferably as an electrode and the like.

According to a method for producing a polymer-particle composite of the invention, a polymer-particle composite can be formed without performing a step of making an ink by mixing a particle with a binder, and thus even a small-sized particle which exhibited a substantial difficulty in handling to form a dispersion such as an aggregation experienced in a step of making an ink can be packed uniformly in a polymeric material by a convenient procedure. Also according to a method of the invention, a large amount of a particle can be packed in a polymeric material, unlike to a conventional technology.

A polymer-particle composite obtained by a method for producing a polymer-particle composite of the invention can be employed in a display material such as a light diffusion plate, an optical material such as a colloidal crystal, a building material such as a wallpaper, a noncombustible material, a catalyst material, a separation membrane, an electrode material, a decorative paper, a film, an accessory and a toy.

DESCRIPTION OF THE PREFERRED EMBODIMENTS

Figure 1:
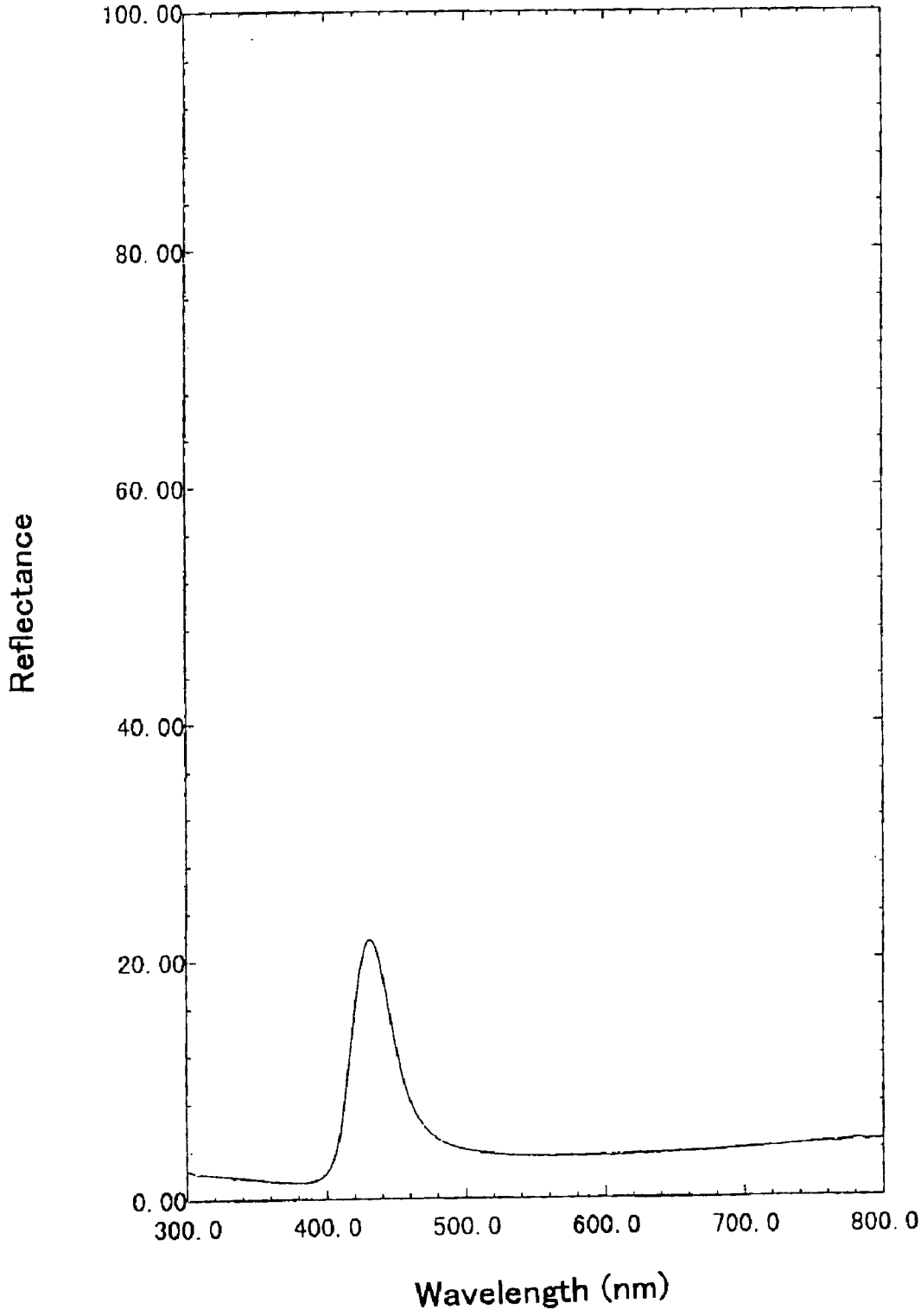
FIG. 1 shows a graph illustrating the reflection spectrum (incidence: 5°) of the polymer-particle composite obtained in Example 1.

A method for producing a polymer-particle composite of the invention is detailed below. A method for producing a polymer-particle composite according to the invention is characterized in that it comprises at least the following two steps:

[1] a step of forming a polymer-containing layer mainly forming of a polymeric material; and,

[2] a step of bringing a particle suspension containing the particle dispersed in a solvent (medium) capable of swelling the polymeric material into contact with the polymer-containing layer. Although there is no proven reason for a success in packing a particle uniformly over a polymeric material using the method described above, several reasons shown below are assumed.

Thus, upon contact between a polymer-containing layer and a particle suspension described above, the solvent of the particle suspension serves to swell the polymeric material in the polymer-containing layer. This swelling is accompanied with the desolvation of the particle dispersed in the particle suspension, and combined further with a hydrogen bond, a van der Waals force and the like, whereby incorporating the particles, as being closer to each other, into the polymeric material. Finally, the force between the incorporated particle and the surrounding polymeric material, such as a van der Waals force, a hydrogen bond, desolvation and the like, serves to immobilize the particle in the polymeric material, whereby packing the particle in the polymeric material. While the interaction between a polymeric material and a particle such as a van der Waals force, a hydrogen bond and the like, as described above, has long been known and utilized industrially for a sludge treatment and the like, it constitutes a unique advantage of the invention when it is restricted to a two-dimensional or a quasi-three dimensional "field". Thus, the present invention provides a polymer-particle composite by restricting the "field" of the interaction between a polymeric material and a particle to the proximity of a polymer-containing layer on a substrate.

Such a polymer-particle composite having a particle packed uniformly therein described above allows even a particle having an extremely small mean particle size, which could not conventionally been dispersed uniformly without aggregation, to be packed uniformly at a high density in a polymeric material, and can also be imparted with a self-standing ability through adjusting a thickness of the polymer-particle composite, whereby providing a wide range of application where the characteristic of the particle are utilized.

Each step in a method for producing a polymer-particle composite according to the invention is detailed below.

The first step of the invention, i.e., a step of forming a polymer-containing layer consisting mainly of a polymeric material is described below.

In the present invention, a method for forming a polymer-containing layer is not particularly limited, and may be a method for forming a sheet alone using an extruder or for forming a layer on a substrate. It is preferred to form a layer on a substrate since a polymer-containing layer in the form of a thin film is useful in most of the cases. A method for forming such a polymer-containing layer on a substrate may employ for example various coating processes such as a spin coating, a screen coating, a roll coating, a dip coating, a die coating and the like. The curing the polymer-containing layer on a substrate may vary depending on the material to be employed, and the solvent may be removed when a polymeric material is present as being dissolved in a solvent, or a thermosetting may be employed when a layer is formed by a reaction on the substrate, or, a irradiation with an actinic ray, such as a light, may also be employed.

A polymer-containing layer may be formed as a pattern on a substrate if necessary. A method for forming a pattern may for example be a direct printing of a desired pattern on a substrate surface using a polyelectrolyte ink, specifically a method using a nozzle injection. Such nozzle injection method may for example be a method employing a microsyringe, a dispenser, an ink jet, or a needle tip from which a polyelectrolyte ink is injected with the aid of an external force such as an electric field, or a method using an oscillating element which oscillates in response to an external stimulation such as a piezoelectric element from which a polyelectrolyte ink is injected, a method in which a polyelectrolyte ink adhering to a needle tip is deposited onto a substrate surface, and the like. Alternatively, a satisfactorily wettable hydrophilic zone is formed as a pattern in a poorly wettable hydrophobic zone, and then coated with a liquid polymeric material, whereby depositing the polymeric material exclusively on the hydrophilic zone, or a photosetting resin is coated over the entire surface of a substrate, which is then subjected to an ordinary method for forming a pattern of a polymeric material such as a pattern exposure.

A substrate employed in the invention, when it is subjected as it is, in combination with a polymeric material formed thereon, to various applications of a polymer-particle composite substrate, may specifically be a metal such as aluminium, copper, stainless steel, zinc and the like, a semiconductor such as silicon, an inorganic substance such as a glass, a film mainly consisting of a polymeric material such as polyethylene terephthalate or polypropylene, as well as an unwoven fabric satisfying its requirement property according to its application. A layer having a varying function may here be provided between a polymer-particle composite and a substrate obtained finally, for example as an adhesive layer to ensure a close contact between the substrate and the polymer-particle composite.

When a polymer-containing layer is formed first on a substrate, and then peeled off, and then subjected to the contact with a particle suspension described below, or when a final polymer-particle composite is formed on a substrate and then peeled from the substrate, and subjected as a polymer-particle composite alone to various applications, a substrate having a property required in a manufacturing process such as a smooth surface is employed, and a release layer facilitating the peeling may be provided on the substrate if necessary.

When such substrate is employed, a polymer-containing layer may be formed on only one side or both sides of a substrate.

A polymeric material mainly from which a polymer-containing layer described above is formed is not particularly limited as long as it is swollen in a solvent (medium) of a particle suspension described below, and may be any of various polymeric materials. The molecular weight or the crosslinking degree of a polymeric materials are not limited particularly, and may vary depending on the utility of a resultant polymer-particle composite. Nevertheless, a too smaller molecular weight is not preferable since it may allow the polymeric material to be dissolved in a particle suspension in the step of a contact with the particle suspension described below, and a polymeric material having a weight mean molecular weight of 5000 or more is preferable.

Among these polymeric materials described above, polyelectrolytes is preferred in the invention, since it is a salt having a high molecular weight and undergoes, when a polymer-containing layer consisting of the polyelectrolytes is brought into contact with a particle suspension, a diffusion into the suspension medium in a manner that an outer molecule is diffused earlier, whereby being surrounded by the salt at an extremely high concentration, where the particle is desolvated and imparted with an instability to lose its repulsive force, resulting in a promotion of the incorporation into the polyelectrolytes which is assisted by a van der Waals force and the like.

Among the polyelectrolytes described above, a polyelectrolyte having a charge opposite to the charge possessed by a particle is preferred, because of the reasons described below.

Thus, generally in a particle suspension containing a particle dispersed uniformly therein, the surface of the particle is charged usually, especially in a polar solvent such as water. At the proximity of this charge, there is a counter ion and the particle is surrounded by an electrical double layer. Accordingly, an electrostatic repulsive force occurs between the particle, resulting in a stable dispersion of the particle over the medium. Also by means of a solvation layer the contact between the particles can be avoided. Thus, a polymeric material on a substrate preferably has a function for inducing an electrostatic attraction between it and a particle and a function for desolvating the particle. Such functions are associated with a polyelectrolyte having a charge opposite to the charge possessed by a particle, and such polyelectrolyte having a charge opposite to the charge possessed by a particle gives an attractive force between it and the particle, resulting in an instability of the particle, which leads to a rapid formation of a composite with the surrounding polyelectrolyte at a high concentration. Accordingly, the particle can be incorporated, packed and immobilized more efficiently when compared with an ordinary polymeric material.

Also in the invention, a polymeric material containing a polyelectrolyte described above is preferably a water-soluble polymer, since in a particle suspension described below a preferably employed particle is dispersed in an aqueous medium in most of the cases and also since in view of a practical use a water-soluble polymer capable of being used in such aqueous particle suspension is preferred. Another reason is that also when a polymer-containing layer consists of a polyelectrolyte and a particle is dispersed in an aqueous medium, the ionization degree can be increased and a higher efficiency is achieved by employing an aqueous system in both of the cases where a high salt concentration region is formed on the surface of the polyelectrolyte to impart a particle in a particle suspension with an instability as described above or where an electrostatic attraction is employed to allow a particle to be incorporated into and immobilized in a polymeric material.

Such water-soluble polyelectrolyte best suited to the present invention may for example be imines such as polyethylene imine, amines such as polyallylamine and polyvinylpyridine, sulfonic acids such as polystyrene-sulfonic acid, carboxylic acids such as polyacrylic acid, naturally-occurring polymers such as gelatin and alginic acid and an ionic polymer salt thereof, amides such as polyacrylamide and the like. Any of these polymers may be modified depending on an intended use, and a copolymer whose monomer component is a polymer listed above may be employed preferably.

While a polymer-containing layer described above consists mainly of a polymer as described above, the expression "mainly" used here is intended to ensure that the materials employed in forming the layer on a substrate such as a solvent, an organic or inorganic salt, a leveling agent and the like may be present in small amounts.

The second step in which a polymer-containing layer described above is brought into contact with a particle suspension is described below.

In the second step, a polymer-containing layer to be brought into contact with a particle suspension may be a polymer-containing layer alone or a substrate having a polymer-containing layer provided thereon as described above. Nevertheless, since a polymer-containing layer in the form of a thin film is useful in view of the final use, it is preferable that the polymer-containing layer is brought, as is still on the substrate, into contact with the particle suspension when taking the strength and the like into consideration.

A method for bringing this polymer-containing layer is brought into contact with the particle suspension may specifically be a method for immersing a polymer-containing layer in a particle suspension or a method for applying a particle suspension onto a polymer-containing layer.

A particle suspension employed in the invention comprises a particle and a medium, the medium (solvent) being capable of swelling a polymeric material mainly from which a polymer-containing layer described above is formed.

A particle to be dispersed in a particle suspension may for example be a dendrimer, a fullerene, a metal particle, a semiconductor particle, an oxide particle and a substance containing carbon as a structural element, specifically a polymeric particle and the like. Such particle may be employed alone or in combination with each other.

Those employed specifically are a metal particle such as Au, Ag and Pd particles, a semiconductor particle such CdS, CdSe and ZnS particles, a metal (semiconductor) oxide particle such as $Al_2O_3$, $TiO_2$, ZnO, $CeO_2$, $Y_2O_3$, $SiO_2$, $ZrO_2$, $Fe_2O_3$, $Ho_2O_3$, $Al_2O_3$/MgO composite oxide, $SnO_2$, MgO, cobalt blue ($CoO \cdot Al_2O_3$), CuO, $Mn_3O_4$, ITO (Indium Tin Oxide), ATO (Antimony Tin Oxide) particles (for example, NanoTek series manufactured by C. I Kasei Company, Limited), a polymer particle such as a crosslinked acrylic particle (for example, MX and MR series manufactured by Soken Chemical & Engineering Co., Ltd), a non-crosslinked acrylic particle (for example, MP series manufactured by Soken Chemical & Engineering Co., Ltd), a crosslinked polystyrene particle (for example, SGP series manufactured by Soken Chemical & Engineering Co., Ltd), a non-crosslinked polystyrene particle, a highly crosslinked monodisperse polymethyl methacrylate particle (for example, MS and M series manufactured by Soken Chemical & Engineering Co., Ltd), as well as a metal-coated particle, a composite particle or a functionalized particle made therefrom.

When an interaction with a polyelectrolyte is utilized to accomplish a uniform dispersion and a package in a polymer in the invention, it is preferable that a electric charge is present on the surface of a particle described above. The electric charge on the surface of a particle may be of the particle itself or of a dispersion stabilizer such as an ionic surfactant which adsorbs on the particle to disperse and stabilize the particle.

The mean particle size of such particle is not particularly limited, and is practically 1 nm or more and 100 $\mu$m or less. While the term "particle size" is employed here, it is a matter of course that the shape of a particle is not limited to a spherical form. In addition the term "particle size" employed here is the particle size of a primary particle and/or a secondary aggregate.

The present invention is characterized markedly by a capability of dispersing and packing even a small sized particle uniformly in a polymeric material without undergoing any aggregation, which is not accomplished by a conventional method in which a particle and a polymeric material are mixed in a solvent, and the particle is dispersed and then the solvent is removed to obtain a polymer-particle composite. In this point of view, a preferable mean particle size is 1 $\mu$m or less.

The concentration of a particle in a particle suspension employed in the invention may vary to control the particle content in the final polymer-particle composite, whereby obtaining the concentration at which a performance required in the use of the final polymer-particle composite can be accomplished. Since several types of the attractive force between a particle and a polymeric material are utilized positively in the invention, the particle concentration in the final polymer-particle composite is considered to be higher generally than a particle concentration in a suspension. In the invention, by adjusting the concentration of a particle suspension, a composite packed with a particle in a close-packed structure can also be obtained. On the other hand, when a polymer-particle composite having a low particle content is intended, then a too lower particle concentration in a particle suspension is not preferred since it allows a polymeric material to be diffused excessively in a solvent (medium), resulting in a poor uniformity of the composite or an aggregation in the particle suspension.

While the suitable concentration of a particle in a suspension may, as described above, vary widely depending on the intended use of the final polymer-particle composite, it is generally 1% by volume to 65% by volume, preferably 1% by volume to 55% by volume, particularly 3% by volume to 50% by volume.

While a medium (solvent) employed in a particle suspension should be capable of swelling a polymeric material described above, the degree of such swelling is preferably within the range from the degree giving a complete dissolution in the medium (solvent) (in case of a non-crosslinked polymeric material) to the degree giving the swelling to a volume approximately twice the initial volume of the polymeric material (in case of a crosslinked or non-crosslinked polymeric material).

A medium (solvent) is not particularly limited as long as it is capable of swelling a polymer-containing layer as described above, and may for example be alcohols such as ethyl alcohol, isopropyl alcohol and the like, amides such as dimethylformamide, sulfoxides such as dimethyl sulfoxide, glycols such as ethylene glycol, as well as water.

Since a water-soluble polymer is preferable as a polymeric material constituting a polymer-containing layer in the invention as described above, a medium (solvent) which dissolves such water-soluble polymer is preferred. Such medium has a dielectric constant preferably of 2 or higher, and may specifically be water (81 (specific dielectric constant at 20° C.; The same applies analogously to the followings unless otherwise specified), methanol (33.2), acetone (21.4), morpholin (7.42 (at 25° C.)), 1,4-dioxane (2.32) and the like.

In the invention, a constituent of a polymer-containing layer is preferably polyelectrolytes as described above, especially a water-soluble polyelectrolyte. Though it is preferable accordingly that the medium in a particle suspension described above also dissolves this water-soluble polyelectrolyte, water is exemplified as a most preferable medium since the highest solubility of this water-soluble polyelectrolyte is observed in water.

Such medium may be employed alone or in combination. An ionic impurity is contained preferably in an amount as small as possible in order to avoid the inhibition of the dispersibility of a particle.

Such particle suspension may contain a surfactant or equivalent if necessary.

While the type of a particle suspension employed in the invention is not particularly limited as long as a uniform dispersion of the particle is obtained, those exemplified preferably are a solid particle dispersion system (dispersion colloid), a molecule-association dispersion system (micelle colloid) and a polymeric dispersion system (molecule colloid).

A method for producing a polymer-particle composite of the invention may involve a step which is required to obtain an intended property of the final polymer-particle composite in addition to the two steps described above.

For example, after completing the two steps described above, a washing step and a drying step may be performed. In addition, a step of forming a protective layer may also be performed after completing the drying step. Furthermore, a step of producing a cell for this polymer-particle composite may be performed after completing the washing step.

In a method for producing a polymer-particle composite of the invention, an improvement in the mechanical strength of the resulting polymer-particle composite may be accomplished in such a manner that a polymerizable material is added previously in a particle suspension or a polymer-containing layer and then incorporated into the polymer-particle composite and irradiated subsequently with a UV light or an electric beam or heated, whereby effecting a polymerization or a crosslinking reaction. Alternatively, a polymeric material may be modified with a polymerizable functional group, or a polymerization-activating group may be introduced into the surface of a particle, or, a particle may also be stabilized using a polymerizable material.

Also in a method for producing a polymer-particle composite of the invention, the packing density of a particle in a polymer, i.e., a desired polymer/particle ratio in a polymer-particle composite, can be obtained by adjusting the concentration of the particle in a particle suspension appropriately, and also by adjusting the time period during which a particle suspension is in contact with a polymer or adjusting the molecular weight of a polymer appropriately. Otherwise, the factors to be adjusted appropriately for obtaining a desired polymer/particle ratio in a polymer-particle composite are, for example, the type of a particle (surface charge density, glass transition temperature, particle size), the type of the dispersion medium of a particle suspension (dielectric constant, pH, salt concentration, dispersion stabilizer content), the type of a polymer (monomer species, ion dissociation degree, branching degree, crosslinking degree), the thickness of a polymer, the temperature at which a particle suspension is brought into contact with a polymer. The factor to be adjusted appropriately can be selected based on the types of a polymer and a particle and a desired polymer/particle ratio in a polymer-particle composite, and any combination of the factors listed above may also be adjusted.

A polymer-particle composite obtained by a method for producing a polymer-particle composite described above is in a gel-like condition with a self-standing ability, and a polymer-particle composite film is formed uniformly on a substrate when such substrate is employed. A method in which a particle suspension is merely combined with a polyelectrolyte solution to form a coating which is then coated results in just an irregular aggregate and no successful formation of a polymer-particle composite exhibiting a uniform dispersion of the particle as being packed throughout a polymeric material as is obtained by an inventive method can be obtained.

A polymer-particle composite obtained by a method according to the invention or equivalent is described below. It is a matter of course that a polymer-particle composite exemplified below is not limited to one produced by a method described above.

A polymer-particle composite according to the invention is characterized by a particle packed uniformly in a polymeric material, a self-standing ability, and a mean particle size of 1 $\mu$m or less.

The first aspect of a polymer-particle composite according to the invention is a uniform dispersion and package of a particle in a polymeric material. Since the type of a polymeric material and the type of a particle employed here are similar to those of a polymeric material and a particle described above in relation to a method for producing a polymer-particle composite according to the invention and a particularly preferred polymeric material is similarly a polyelectrolyte having a charge opposite to the charge possessed by a particle described above, no further description is made here.

The expression that "a particle is dispersed uniformly" employed here means not only that the particle is not forming an aggregate but also that the interval of the particles is not irregular such as in a case where a polymeric material and a particle are present as layers. Thus, a polymer-particle composite according to the invention is characterized firstly that a particle is dispersed in a polymeric material without undergoing any aggregation while the interval of the particles is almost constant.

The second aspect of a polymer-particle composite according to the invention is a self-standlng ability. Thus, a polymer-particle composite according to the invention is capable of maintaining its shape without a substrate, and can also be used without being supported on a substrate if necessary. In order to obtain such a polymer-particle composite which is not supported on a substrate, a polymer-particle composite is formed on a substrate and subsequently peeled off from the substrate, or only a polymer-containing layer is formed previously and subsequently brought into contact with a particle suspension, as described above.

A further aspect of a polymer-particle composite according to the invention is a uniform dispersion of a particle having a mean particle size of 1 $\mu$m or less in a polymeric material. Thus, a polymer-particle composite according to the invention is, as evident from a method for producing it described above, may be obtained as one containing a particle having a varying mean particle size dispersed therein. Nevertheless, a polymer-particle composite desired recently is one having a uniformly dispersed particle which has a small particle size and could not be dispersed uniformly by a conventional method in which is a particle is dispersed by adding the particle to a solution of a polymeric material in a solvent and then stirring the mixture. In this point of view, the particle size as a property of a polymer-particle composite of the invention is 1 $\mu$m or less, preferably 0.8 m or less, and particularly 0.5 $\mu$m or less.

A further aspect of a polymer-particle composite according to the invention is a capability of dispersing and packing a large amount of a particle, which has been difficult to be dispersed without aggregation, uniformly in a polymeric material. While the specific amount of a particle to be packed may vary widely depending on the intended use of a polymer-particle composite, the type of the particle, the type of a polymeric material and the film thickness, an amount is usually of 1% by volume or more, preferably, of 10.% by volume or more, particularly of 30% by volume or more, can be dispersed and packed uniformly in the polymeric material. When a spherical particle having a uniform particle size is used, a close-packed structure may also be obtained.

A polymer-particle composite according to the invention can also be one wherein the particle content in a polymeric material varies continuously over the range from one side to the other. Such composite can be produced, in a method for producing a polymer-particle composite described above, by using a thick polymer-containing layer or by shortening the time of a contact of polymer-containing layer and particle suspension. The expression "varies continuously over the range from one side to the other" used herein means not only that the content is increased (decreased) continuously over the range from one side to the other but also that the content is increased continuously from one side to the center and then decreased continuously from the center to the other side.

In a polymer-particle composite according to the invention, any parameter other than the particle content described above, such as the electric conductivity and the substance permeability, can also vary continuously over the range from one side to the other.

A polymer-particle composite according to the invention may also be one wherein a polymer-particle composite is formed as a pattern on a substrate. The surface of a polymer-particle composite may be covered with a water-proof overcoat layer in order to improve the water resistance of the material containing this polymer-particle composite, or when a polymer-particle composite is used, still when containing a solvent, as a material, it may be formed in a cell having a sealed circumference using an adhesive or equivalent.

A polymer-particle composite described above may be used as a colloidal crystal employing a true spherical particle and a composite employing a titanium oxide-mica composite particle in the field of an optics, as a composite employing a photocatalytically active titanium in the field of a catalyst and an electrochemistry, as a composite employing ITO or ATO in the field of an electrode, as a composite employing a semiconductor particle such as CdS, CdSe and ZnS in the field of a display and an electric device, and as a composite employing a metal particle such as Pt, Au and Pb in the field of optics, catalyst and electrochemistry.

A porous material employing a polymer-particle composite described above is described below. A porous material can be classified into any of the two types, namely, a porous material obtained by subjecting a polymer-particle composite described above to a heat treatment such as a drying or a sintering (hereinafter sometimes referred to as a first porous material), and a porous material obtained by using a polymer-particle composite described above as a mold the pore of which is filled with a certain material followed by the removal of a particle (hereinafter sometimes referred to as a second porous material).

While a first porous material described above is a porous material in which a pore present between particles exists as a pore and may vary widely depending on the packing density of a particle in a polymer-particle composite, it can be obtained as one having a large specific surface area and a small porosity. Such first porous material may be formed generally by forming a polymer-particle composite using silicon oxide or titanium oxide as a particle followed by sintering the composite into a porous material whereby forming a sintered particle, as is effected in a so-called hydrothermal method.

On the other hand, a second porous material described above can be a porous material having a high porosity and a constant (although depending on the particle employed) pore size, since the region of a particle in a polymer-particle composition described above comes to exist as a pore. Also by packing a substance in the interstice between the particle by any of various techniques as described below, a porous material of a varying substance can advantageously be produced.

In a method for producing such second porous material, a particle capable of being decomposed by a heat or chemical treatment or extracted is used to perform a step of forming a polymer-particle composite by a method for producing a polymer-particle composite described above. Subsequently, a step of packing a certain substance in a pore between the particles of the polymer-particle composite described above is performed and then a step of removing the particle by means of a decomposition or extraction of the particle in the polymer-particle composite by a heat or chemical treatment is performed to obtain a porous material. A method for producing this second porous material is detailed below.

In a method for producing this second porous material according to the invention, a polymer-particle composite is first produced. A method for producing this polymer-particle composite is detailed above and not discussed here.

Then a pore of this polymer-particle composite is packed with a substance, optionally after performing a pretreatment such as a sintering, heating or pressurizing. Such pretreatment is performed to communicate the particle with each other whereby communicating the pores three-dimensionally in the final porous material. When a polymeric material surrounding a particle should be removed for a certain purpose of use, the polymer can be removed by heating or washing.

A pore in a polymer-particle composite thus pretreated is then packed with a substance. A method for packing a substance may for example be any of the following three methods.

1. Plating such as electrolytic plating or electroless plating

For example, a plating with a metal salt such as silver nitrate, copper sulfate, cobalt sulfate, nickel sulfate and nickel chloride or a semiconductor salt such as cadmium sulfate and selenium oxide is performed to pack a metal in a pore between particles. In this method, a compound before being reduced can generally be introduced easily into a pore between particles (cavity of the mold), and then be packed in the pore between the particles upon a subsequent precipitation. Accordingly, even when the particle is removed, a porous material can still be self-standing, and thus this method is useful especially when a metal porous material is intended.

2. Method by using polymerizable material

A compound having a low molecular weight is packed in a pore between particles, and then allowed to polymerize, whereby packing a polymer. A low viscosity before the polymerization enables a relatively easy filling within the pore between the particles, and the polymerization after filling provides a strength sufficient to maintain the self-standing ability even after removing the particle.

Specifically, a metal alkoxide is filled in a pore between particles and then condensed within the pore between the particles in a polymer-particle composite, as is in a so-called sol-gel method, or an organic monomer or oligomer is polymerized by a condensation or addition reaction to fill a polymer formed in a pore between particles in a polymer-particle composite. When a sol-gel method described above is employed then silicon alkoxides, titanium alkoxides, zirconium alkoxides and aluminium alkoxides may be employed, while when an organic monomer or oligomer is employed then those which can be employed are (meth) acrylates for obtaining poly(meth)acrylate, isocyanates/alcohols (phenols) for obtaining polyurethanes, isocyanates/amines for obtaining polyureas, epoxides/alcohols for obtaining epoxy resins, carboxylic acids/amines for obtaining polyamides, carboxylic acids/alcohols (phenols) for obtaining polyesters and the like.

3. Dry plating method such as CVD (chemical vapor deposition)

A dry plating method such as a vacuum vapor deposition, a spattering and a CVD is employed to fill a substance in a pore between particles. In such dry plating method, a filling in a pore can be accomplished even when the particle size or the pore is extremely small, since the substance is a gas before being deposited. Specifically, a porous material consisting of indium tin oxide (ITO), graphite, a glassy carbon, diamond, and the like can be formed.

In the present invention, a plating is a representative method in view of the ability of obtaining a metal porous material useful in an electrode.

After filling a certain substance in an interstice between particles, the particle is decomposed by a heat or chemical treatment or is extracted. Specifically, a particle which is a non-crosslinked polymer can be removed by a calcination or an extraction with a solvent. A particle which is a crosslinked polymer can be removed by a calcination. A particle which is a silica can be removed by an extraction with hydrofluoric acid.

After removing a particle as described above, various work-ups may be performed if necessary. For example, when a porous material is formed from a metal, an oxidation is useful for obtaining a porous material of a metal oxide.

While a porous material (first porous material or second porous material) thus obtained varies greatly depending on a particle employed, it can be a mesoporous or macroporus material, which can for example be employed in a catalyst, a separation membrane, an electrode, a capacitor, a photonic crystal and the like.

Also in the invention, the polymer region of a polymer-particle composite is removed by heating or equivalent and the resultant void is filled with another substance, whereby obtaining an embedded particle which is a particle embedded in a varying substance. The use of such embedded particle is a photonic crystal having a broad band gap obtained by filling CdS by a vapor phase synthesis in a pore in a compacted $SiO_2$ microparticle, a dye-sensitized solar cell part obtained by filling a conductive polymer such as polyaniline or polypyrrole in a pore in a compacted $TiO_2$ microparticle, a luminescent device obtained by filling a semiconductive polymer such as poly-p-phenylenevinylene in a pore in a compacted $SiO_2$ supermicroparticle, and the like. Such embedded microparticle may be produced by forming a pore in a composite by drying under a condition which does not sinter a polymer-particle composite and then filling a required substance into the void thus formed, or may be produced by sintering a polymer-particle composite followed by filling a required substance into a pore.

The present invention is not restricted to the embodiments discussed above. The embodiments discussed above are only illustrative, and any modification which is essentially the same to the invention defined in the appended claims and which exerts the same effect is within the scope of the invention.

EXAMPLES

The present invention is further described in the following examples.

Example 1

A glass substrate was spin-coated with a 5% by weight aqueous solution of polydiallyldimethylammonium chloride (Aldrich). After drying at 80° C. for 30 minutes, this coated glass substrate was immersed in a colloidal silica suspension whose particle size was 180 nm ($SiO_2$ concentration: 40% by weight, Nissan Chemical Industries, Ltd) to obtain a silica particle-polydiallyldimethylammonium chloride composite film within several seconds. A part of the polymeric diallyldimehylammonium chloride was considered to undergo a counter ion exchange with $—O^-Na^+$on the surface of the silica particle whereby forming an ionic bond, as shown below.

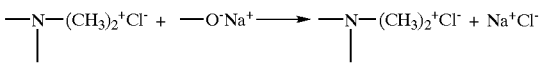

The reflection spectrum (incidence: 5°) of the silica particle-polydiallyldimethylammonium chloride composite after drying for a day at room temperature is shown in FIG. 1. A peak indicating that the silica particle was packed in the composite film periodically (peak wavelength: 431.5 nm) was observed clearly.

Example 2

Figure 2:
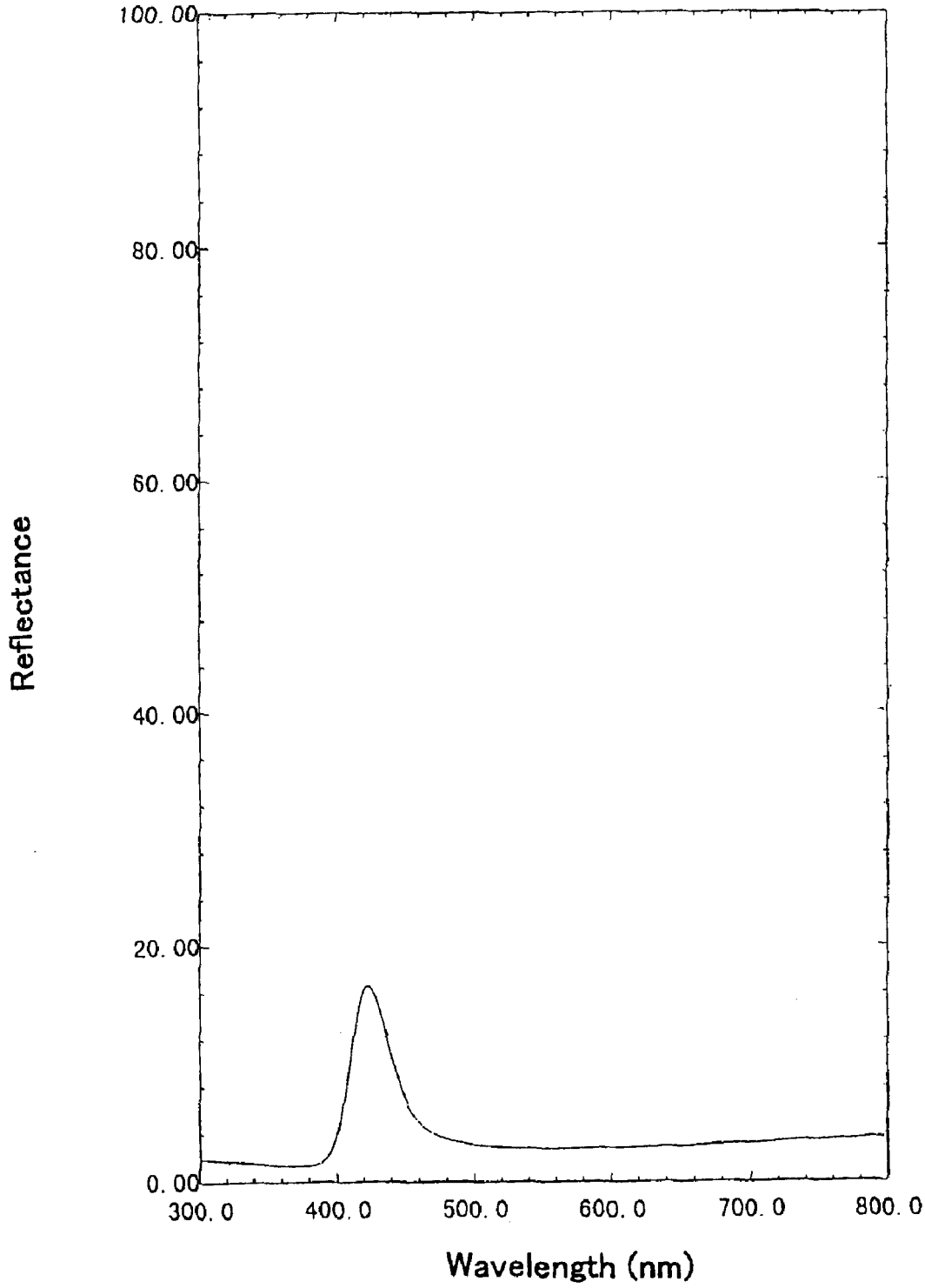
FIG. 2 shows a graph illustrating the reflection spectrum (incidence: 5°) of the sintered particle obtained in Example 2.
Figure 3A:
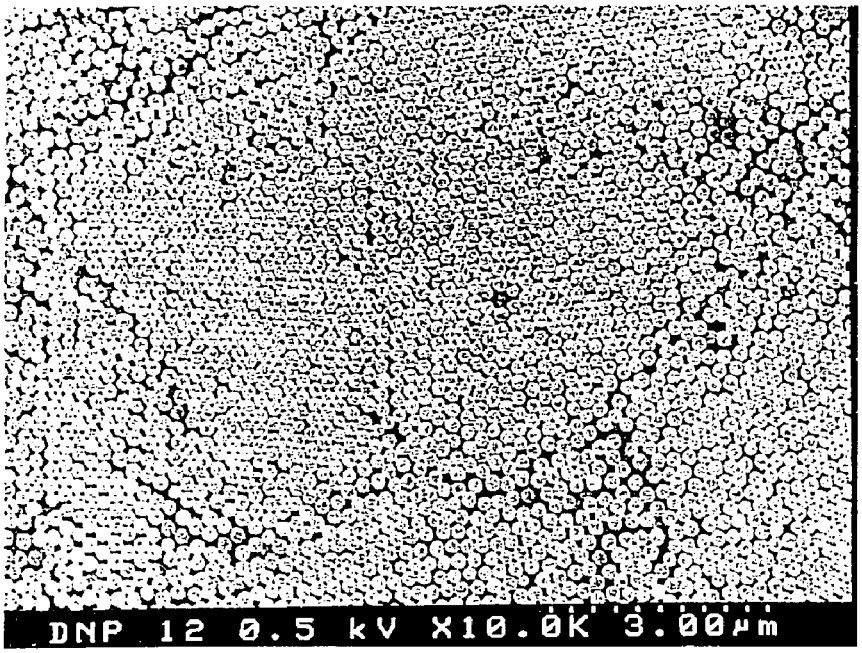
FIG. 3 is a scanning electron microscopic photograph illustrating the surface and the sectional area of the sintered particle obtained in Example 2.
Figure 3B:
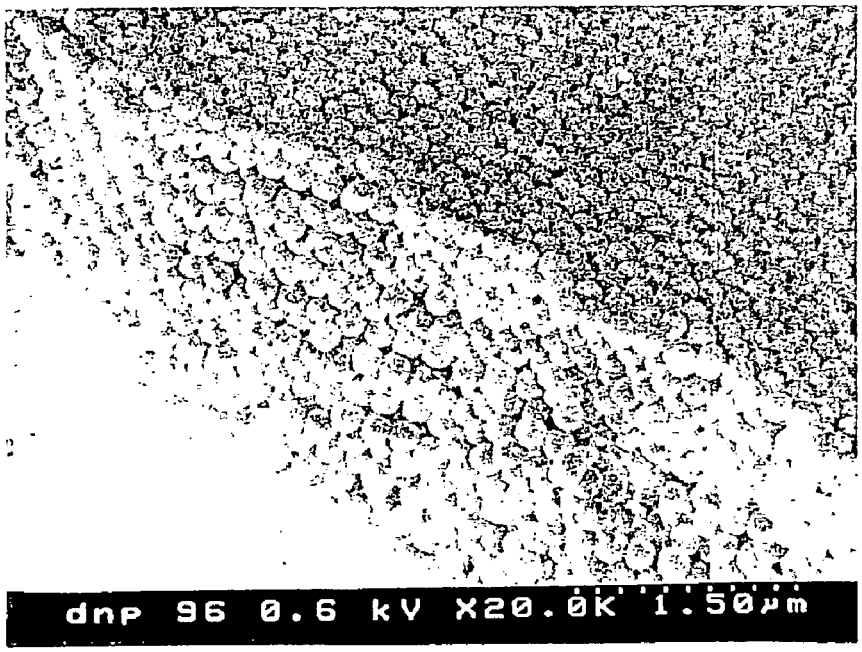

A polymer-particle composite obtained similarly to Example 1 was sintered at 750° C. for 3 hours to obtain a sintered silica particle. This sintered particle had the reflection spectrum (incidence: 50) shown in FIG. 2. A peak indicating that the silica particle was packed periodically (peak wavelength: 422.5 nm) also in the sintered composite was observed clearly. FIG. 3 shows a scanning electron microscopic photograph illustrating the surface and the sectional area of the sintered particle. It reveals that the particle was packed periodically on the surface and the sectional area.

Example 3

Figure 4:
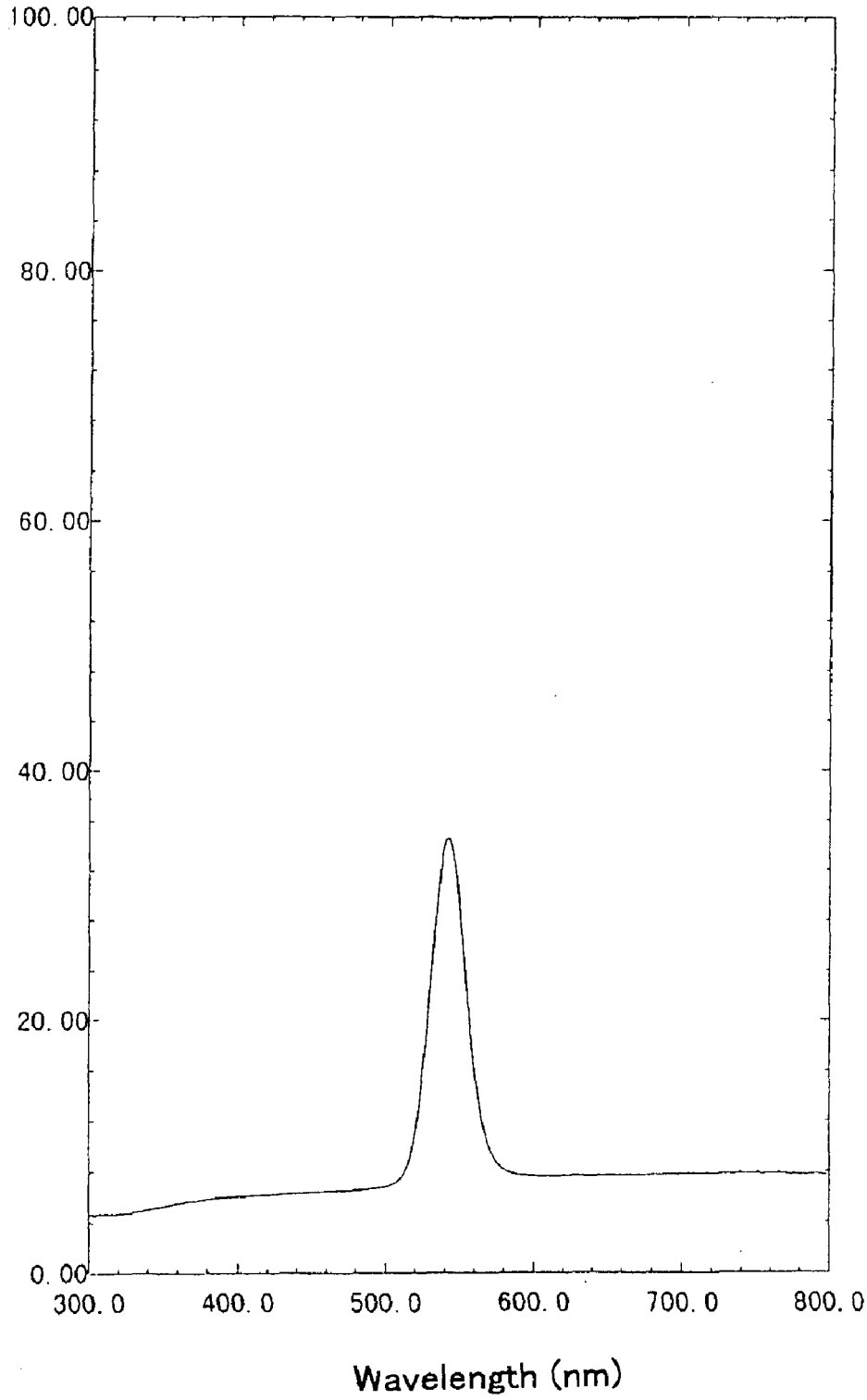
FIG. 4 shows a graph illustrating the reflection spectrum (incidence: 5°, peak wavelength:540.5 nm) of the sealed material obtained in Example 3.
Figure 5:
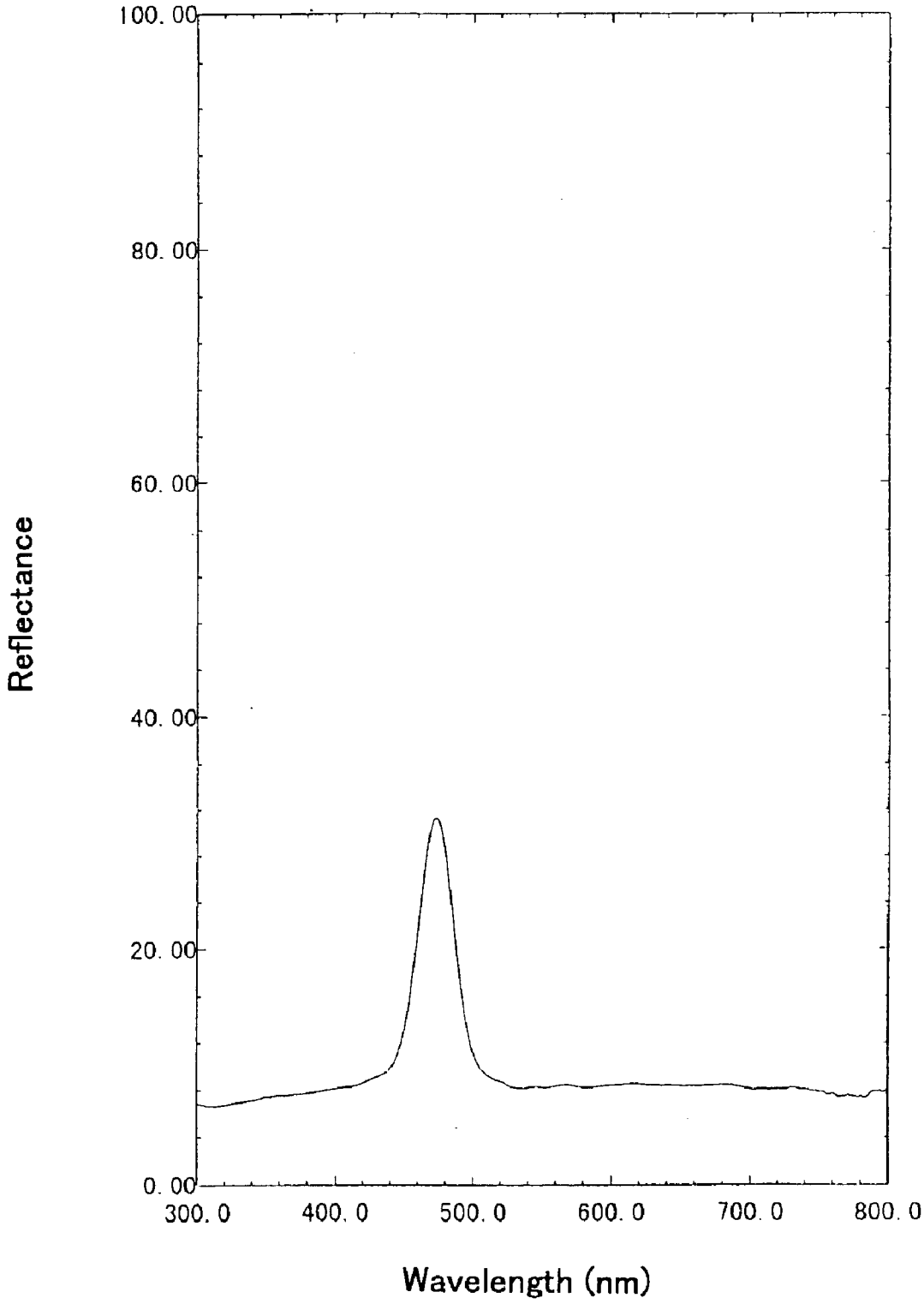
FIG. 5 shows a graph illustrating the reflection spectrum (incidence: 45°, peak wavelength:473.0 nm) of the sealed material obtained in Example 3.
Figure 6:
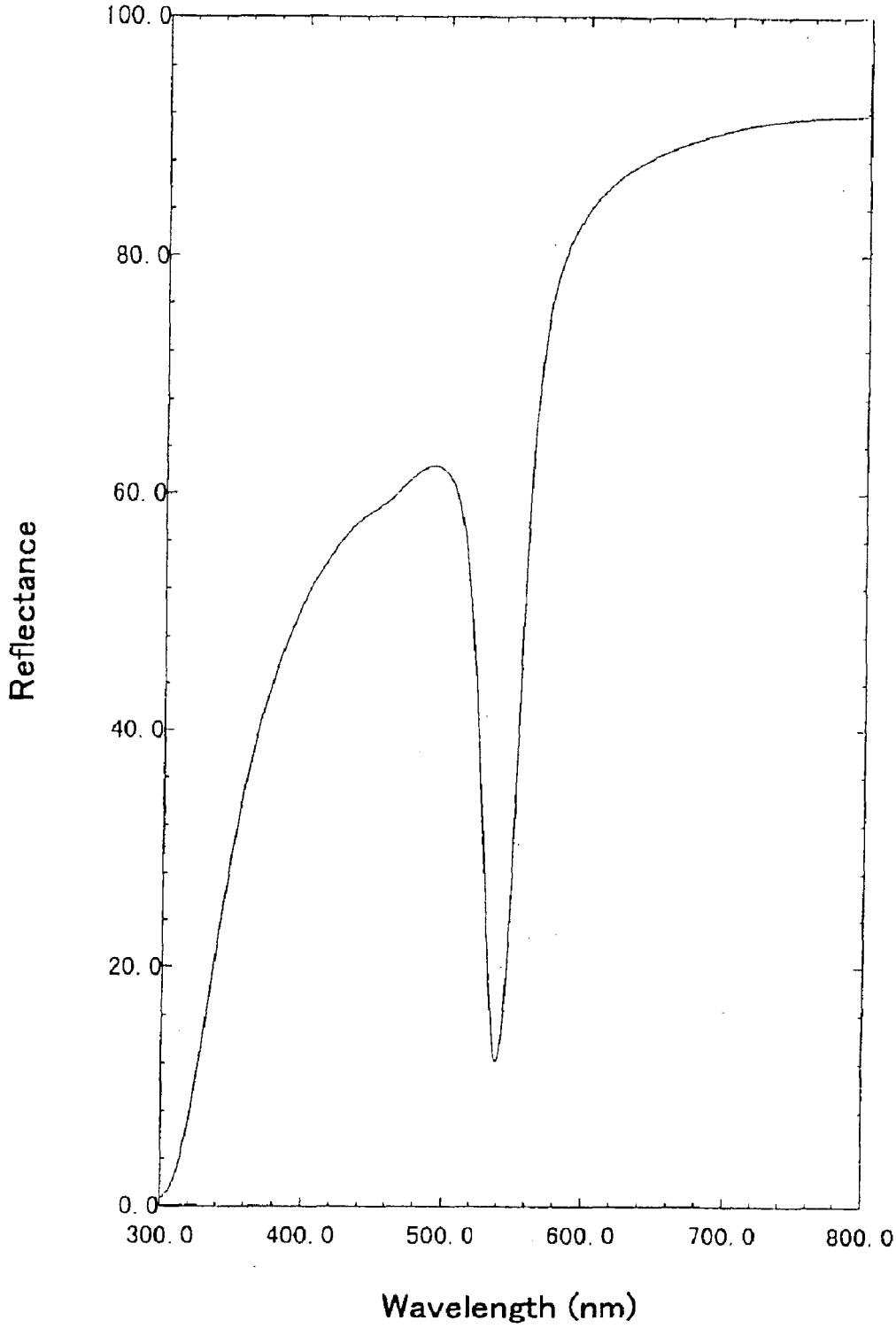
FIG. 6 shows a graph illustrating the transmission spectrum (incidence: 0°, peak wavelength:538.0 nm) of the sealed material obtained in Example 3.

A polymer-particle composite obtained similarly to Example 1 was sandwiched, as still being soaked with water without drying, between two glass substrates, the circumference of which was sealed to obtain a sealed material (artificial opal) which reflected a visible light like a naturally-occurring opal. This phenomenon indicated that a colloidal crystal was formed in this polymer-particle composite. FIGS. 4, 5 and 6 show the reflection spectra (FIG. 4: incidence: 5°, peak wavelength:540.5 nm, FIG. 5: incidence: 45°, peak wavelength:473.0 nm) and the transmission spectrum (FIG. 6: incidence: 0°, peak wavelength:538.0 nm) of this sealed material. Each figure revealed that the silica particle was packed periodically.

Example 4

Figure 7A:
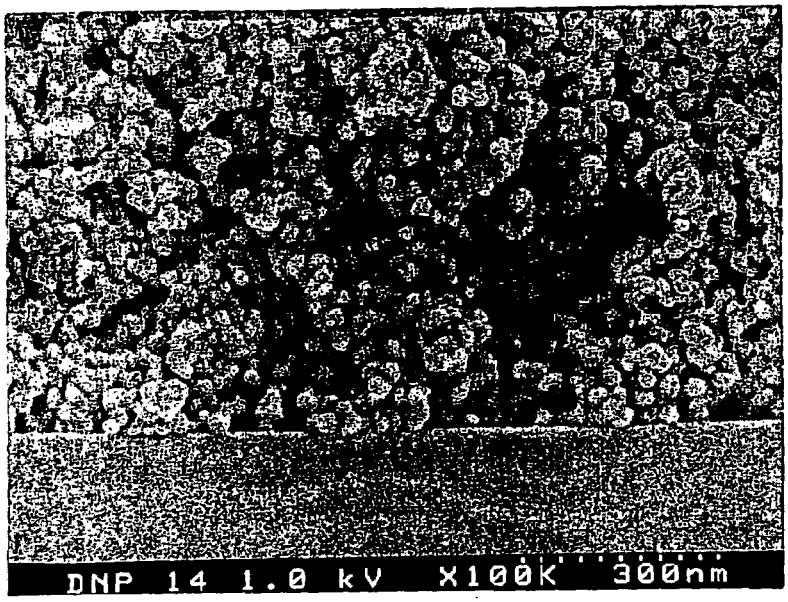
FIG. 7 is a scanning electron microscopic photograph illustrating the sectional area of the composite film obtained in Example 4.
Figure 7B:
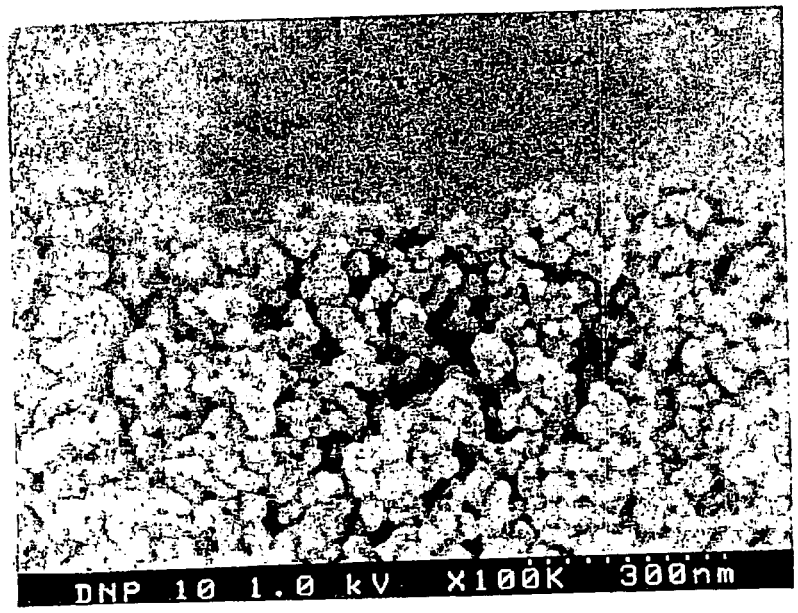

A glass substrate was spin-coated with a 2% by weight aqueous solution of polydiallyldimethylammonium chloride (Aldrich). After drying at 60° C. for 30 minutes, this coated glass substrate was immersed for 60 seconds in a photocatalystically active titanium slurry whose particle size was 20 to 30 nm (ISHIHARA SANGYO KAISHA, LTD.) and then washed thoroughly with a deionized water to obtain a titanium oxide-polyelectrolyte composite film. FIG. 7 shows a scanning electron microscopic photograph illustrating the sectional area of this composite film. It reveals a porous film in which the titanium oxide particle is packed closely.

Example 5

A glass substrate was provided with a 5 mm line-and-space stripe pattern using a masking film, and spin-coated with polydiallyldimethylammonium chloride employed in Example 1. After drying at 50° C. for 60 minutes followed by peeling the masking film off followed by immersing in a colloidal silica suspension employed in Example 1, a composite film was formed within several seconds exclusively on the region coated with the polymer.

Example 6

An unwoven fabric (UNICHIKA LTD., Product Code AP080 BKE) was immersed in a 2% by weight aqueous solution of the polyelectrolyte employed in Example 1, dried and then immersed in the colloidal silica suspension employed in Example 1, resulting in a rapid formation of a silica particle-polydiallyldimethylammonium chloride composite film around a fiber of the unwoven fabric.

Example 7

On a glass substrate, a dot pattern by a point drawing, and a spiral pattern and a lattice pattern by a line drawing, were made manually using an ink consisting of a 10% by weight aqueous solution of polydiallyldimethylammonium chloride. After evaporating the solvent off, the substrate was immersed in Colloidal Silica MP-1040 (Trade name, Nissan Chemical Industries, Ltd) to obtain a polyelectrolyte-silica particle composite having the dot pattern, the spiral pattern and the lattice pattern.

Example 8

Using Polymer Latex JSR 0640 (Trade name, JSR, particle size: 240 nm) as a particle suspension, a polyelectrolyte-polymeric particle composite having a dot pattern, a spiral pattern and a lattice pattern was obtained similarly to Example 7.

Example 9

Using Polymer Emulsion AE 404 (Trade name, JSR, particle size: 35 nm) as a particle suspension, a polyelectrolyte-polymeric particle composite film was obtained similarly to Example 1.

Example 10

Using an acrylic emulsion whose mean particle size was 130 nm as a particle suspension, a polyelectrolyte-polymeric particle composite film was obtained similarly to Example 1.

Example 11

Using the composite film prepared in Example 10 as a mold, a nickel electroless plating was attempted by an ordinary method, resulting in a formation of a black film having a metallic gloss within several seconds. Subsequently, an acrylic particle was extracted with toluene, and the remaining organic substances were removed in an inert gas atmosphere at 400° C., whereby obtaining a porous nickel film. This film was used as an electrode to perform a gold plating, whereby obtaining a porous nickel/gold film.

Example 12

Figure 8:
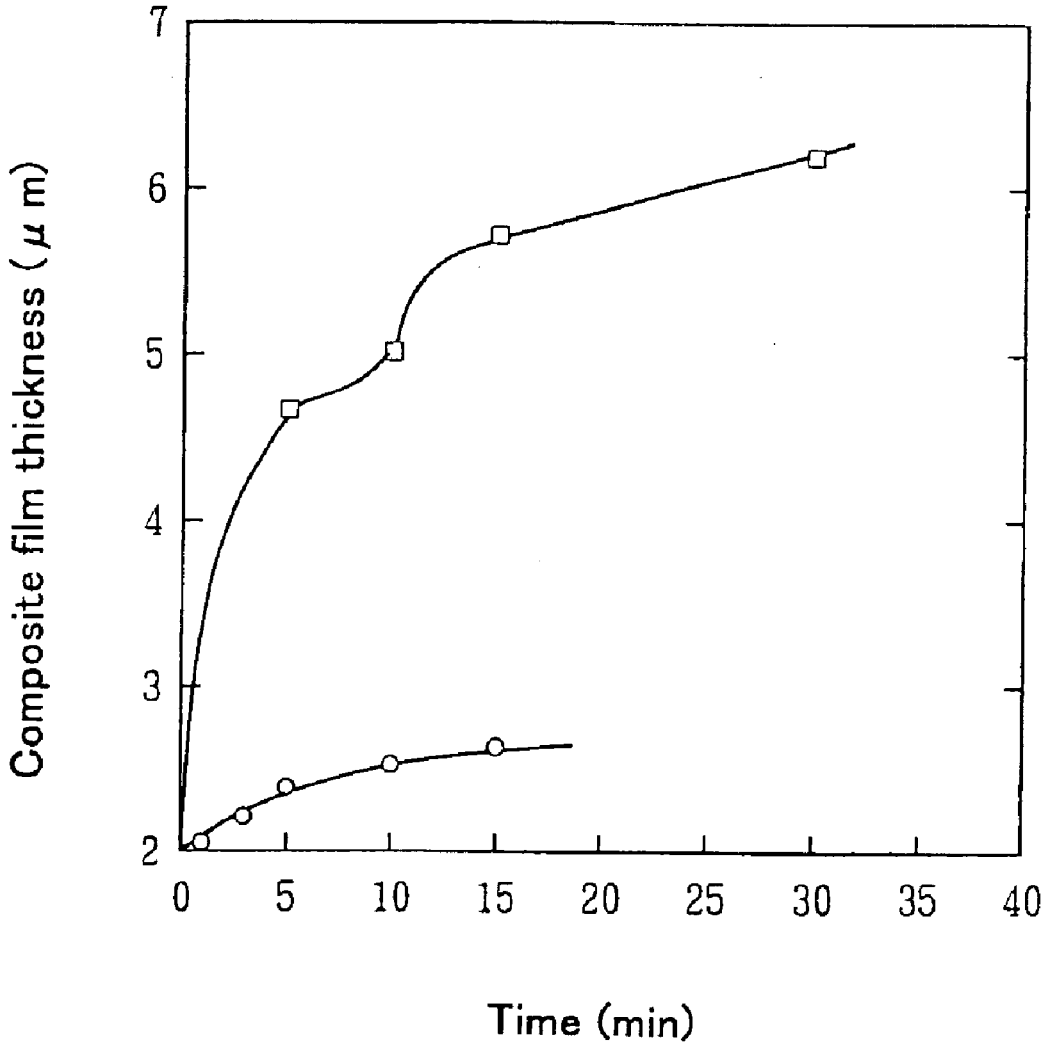
FIG. 8 shows a graph indicating the relationship between the contact time and the composite film thickness in Example 12.

Using polydiallyldimethylammonium chloride employed in Example 1 (molecular weight: 100,000 to 200,000), a polydiallyldimethylammonium chloride thin film whose thickness was 0.15 μm or 0.60 μm was formed on a glass substrate. Each film was immersed in the titanium oxide slurry employed in Example 4 and the relationship between the immersion time period and the thickness of the resultant composite film was investigated (composite-forming temperature was room temperature). The results are shown in FIG. 8. An open circle represents the 0.15 μm film, while an open square represents the 0.60 μm film. This figure reveals that the thickness of the composite film exhibited a relatively rapid increase at an early stage of the composite formation, and thereafter tended to be plateaued. FIG. 8 shows that an intended particle/matrix polymer ratio of the composite film can be obtained by adjusting the composite-forming time period.

Example 13

Figure 9:
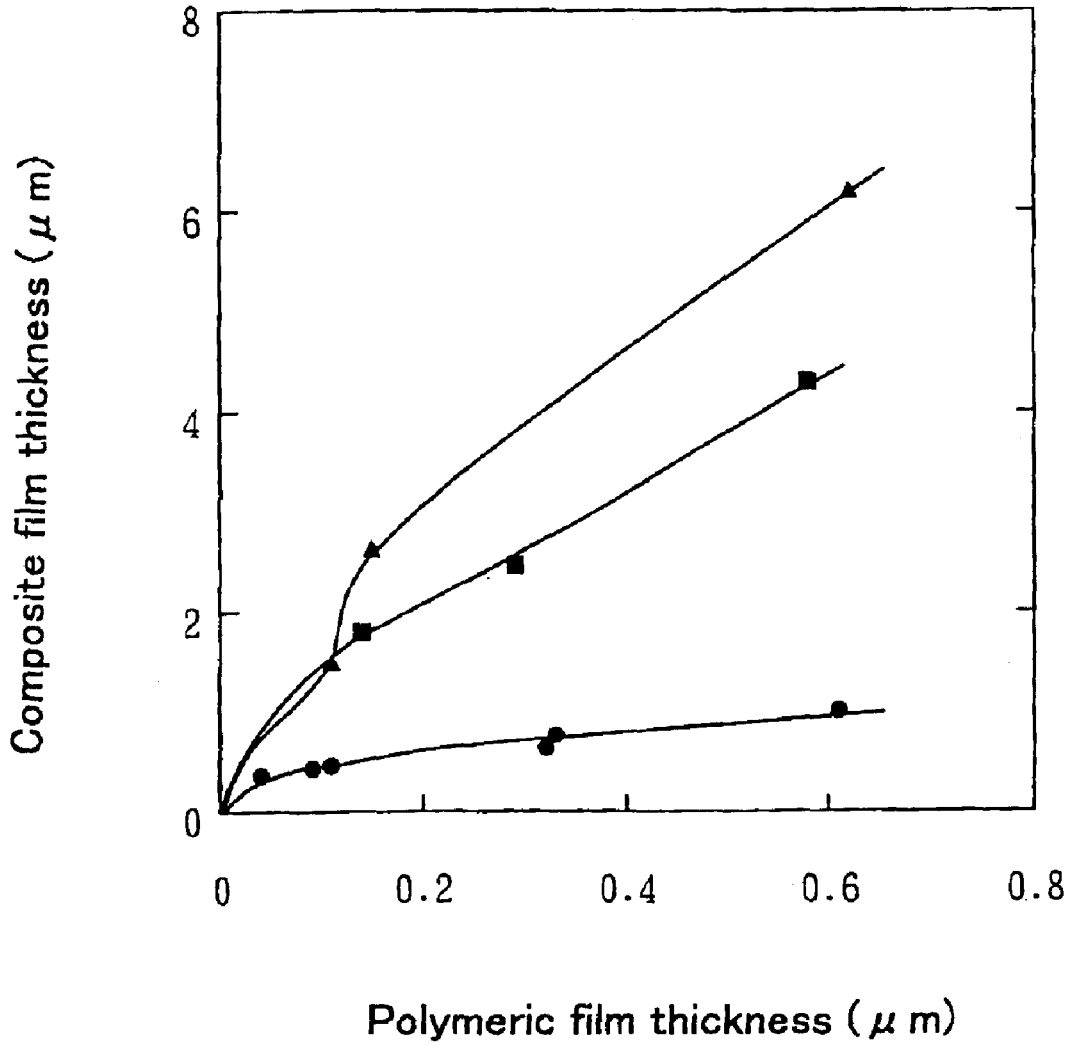
FIG. 9 shows a graph indicating the relationship between the polymeric film thickness and the composite film thickness with a varying molecular weight in Example 13.

Each of the three strongly cationic polyelectrolytes, namely a polydiallyldimethylammonium chloride (molecular weight: 100,000 to 200,000), a polydiallyldimethylammonium chloride (molecular weight: 400,000 to 500,000, Aldrich) and a (meth)acrylate-based cationic polyelectrolyte (Trade name, C-200H, molecular weight: 2,500,000, strongly cationic homopolymer, DAIICHI KOGYO SEIYAKU CO,. LTD), was employed as a polyelectrolyte together with the titanium oxide slurry employed in Example 4 (ISHIHARA SANGYO KAISHA, LTD. KK) to prepare a polyelectrolyte-titanium oxide composite film. The procedure similar to that in Example 11 was performed and the composite film thickness after an immersion time period sufficient for almost saturating the composite film vs the initial polymer film thickness was plotted as shown in FIG. 9. In this figure, a closed triangle represents the polydiallyldimethylammonium chloride (molecular weight: 100,000 to 200,000), a closed square represents the polydiallyldimethylammonium chloride (molecular weight: 400,000 to 500,000) and a closed circle represents C-200H. FIG. 9 reveals that a polyelectrolyte having a smaller molecular weight gave a thicker composite film. FIG. 9 indicates that an intended particle/matrix polymer ratio of the composite film can be obtained by selecting the molecular weight of the polyelectrolyte employed.

Example 14

A SUS plate was defatted and its surface was blasted to form an irregular profile, and was used as a substrate to form a polyelectrolyte-polymer-particle composite film on the SUS substrate.

Example 15

Using the composite film-attached SUS plate prepared in Example 14 as an electrode, a copper plating was performed. The film was heated at 400° C. in the presence of air to form a porous copper oxide (II) film in which the microcrystalline copper oxide (II) was porous.

Example 16

Using diallyldimethylammonium chloride-acrylamide copolymer (Aldrich), a polyelectrolyte-colloidal silica composite film was prepared similarly to Example 1. This composite film had an opal-like gloss similarly to Example 1.

Example 17

Using a silver nanoparticle dispersion paste produced as a prototype by NIPPON PAINT (silver particle (15.7% by weight, 5 to 10 nm), protective resin (6.3% by weight) and water (78.0% by weight)) instead of a colloidal silica, a silver nanoparticle-polydiallyldimethylammonium chloride composite film was prepared similarly to Example 1. This composite film was heated in an inert gas atmosphere at 350° C. to obtain a conductive coating.

What is claimed is:

1. A method for producing a polymer-particle composite comprising:

forming a layer containing a polymeric material, wherein the layer has a thickness between approximately 0.04 μm and 0.6 μm, and packing particles in the polymeric material by contacting the layer with a particle suspension, which contains a dispersion of the particles in a solvent capable of swelling the polymeric material.

2. A method for producing a polymer-particle composite according to claim 1 wherein the layer is formed on a substrate and is brought into contact with the particle suspension.

3. A method for producing a polymer-particle composite according to claim 2 wherein the layer is formed as a pattern on the substrate.

4. A method for producing a polymer-particle composite according to claim 2 wherein the substrate is selected from a group consisting of a metal, a semiconductor, an inorganic material, a film and an unwoven fabric.

5. A method for producing a polymer-particle composite according to claim 1 wherein the step of packing particles in the polymeric material comprises immersing the layer in the particle suspension or a step of applying the particle suspension onto the layer.

6. A method for producing a polymer-particle composite according to claim 1 wherein the polymeric material is a polyelectrolyte.

7. A method for producing a polymer-particle composite according to claim 6 wherein the polyelectrolyte is a polyelectrolyte having a charge opposite to the charge possessed by the particles.

8. A method for producing a polymer-particle composite according to claim 6 wherein the polyelectrolyte is a water-soluble polyelectrolyte.

9. A method for producing a polymer-particle composite according to claim 1 wherein a mean particle size of the particles is 1 nm to 100 μm.

10. A method for producing a polymer-particle composite according to claim 9 wherein the particles are selected from a group consisting of an oxide, a metal, a semiconductor and a substance containing carbon as a structural element, or a mixture thereof.

11. A method for producing a polymer-particle composite according to claim 1 wherein the concentration of the particles in the particle suspension is 1% by volume to 65% by weight.

12. A method for producing a polymer-particle composite according to claim 1 wherein the solvent capable of swelling the polymeric material is a solvent having a dielectric constant of 2 or more or a mixture thereof.

13. A method for producing a polymer-particle composite according to claim 12 wherein the solvent capable of swelling the polymeric material is a solvent containing water.

14. A method for producing a porous material comprising:

forming a layer containing a polymeric material, forming a polymer-particle composite by packing particles in the polymeric material by contacting the layer with a particle suspension, which contains a dispersion of the particles in a solvent capable of swelling the polymeric material, wherein the particles are capable of decomposition by means of a heat treatment, a chemical treatment, or by, filling a material into a pore between the particles in the polymer-particle composite, and decomposing the particles in the polymer-particle composite by means of a heat treatment, a chemical treatment, or by extraction.

15. A method for producing a porous material according to claim 14 wherein the step of filling a certain material into a pore between the particles in the polymer-particle composite is a step of filling metal into a pore between the particles by means of an electrolytic planting or an electroless plating.

16. A method for producing a polymer-particle composite according to claim 1, wherein a degree of the swelling of the polymeric material is within the range from a degree giving a complete dissolution in the solvent to a degree giving the swelling to a volume twice the initial volume of the polymeric material.

* * * * *